United States Patent [19]

Guarnaschelli

[11] 4,351,389

[45] Sep. 28, 1982

[54] HEAT EXCHANGER APPARATUS

[76] Inventor: Stephen Guarnaschelli, 4608 Wayfarer Pl., Orlando, Fla. 32807

[21] Appl. No.: 287,376

[22] Filed: Jul. 27, 1981

[51] Int. Cl.[3] ..... F28F 1/42

[52] U.S. Cl. ..... 165/141; 165/156; 165/169; 165/184

[58] Field of Search ..... 165/140, 141, 169, 154, 165/156, 164, 184

[56] References Cited

U.S. PATENT DOCUMENTS

| | | | |
|---|---|---|---|
| 342,871 | 6/1886 | Hocking | 165/111 |
| 3,468,371 | 9/1969 | Menze | 165/156 |

FOREIGN PATENT DOCUMENTS

| | | | |
|---|---|---|---|
| 31764 | 12/1887 | Fed. Rep. of Germany | 165/156 |
| 118489 | 2/1900 | Fed. Rep. of Germany | 165/141 |
| 661853 | 11/1951 | United Kingdom | 165/156 |

*Primary Examiner*—Sheldon J. Richter

*Attorney, Agent, or Firm*—William M. Hobby, III

[57] ABSTRACT

A heat exchanger apparatus has a center pipe and an outer pipe formed with spiralling grooves attached to the outside of the center pipe. The outer pipe grooves are pressed against the center pipe to form a spiralling passageway around the center pipe between the center pipe and outer pipe. The center pipe has spiralling grooves co-acting with the outer pipe spiralling grooves so that a portion of the outer pipe grooves fit in the center pipe's grooves. Fluid passing through the center pipe has a predetermined turbulence created therein. Cooling fins are mounted in the grooves of the outer pipe in contact with the groove walls to remove heat from both the center pipe and the outer pipe. Special end couplers are provided for connecting the end of the heat exchanger to a liquid input or output for both the center pipe and the outer pipe separately. A coupler for connecting abutting heat exchange units connects the center and outer pipes separately to make longer lengths.

10 Claims, 5 Drawing Figures

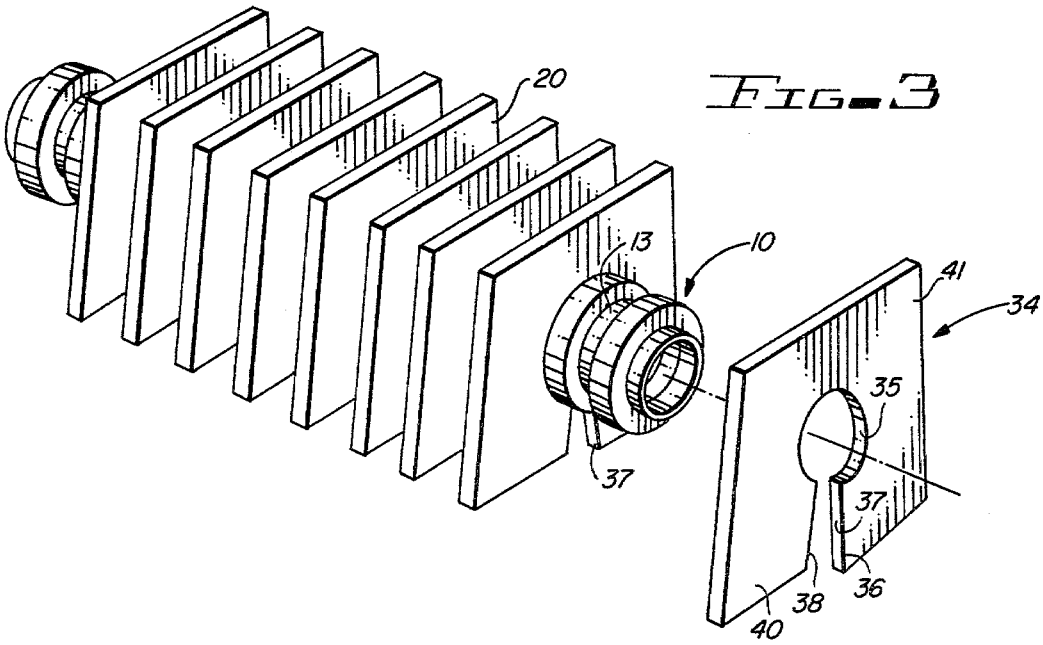
FIG-3
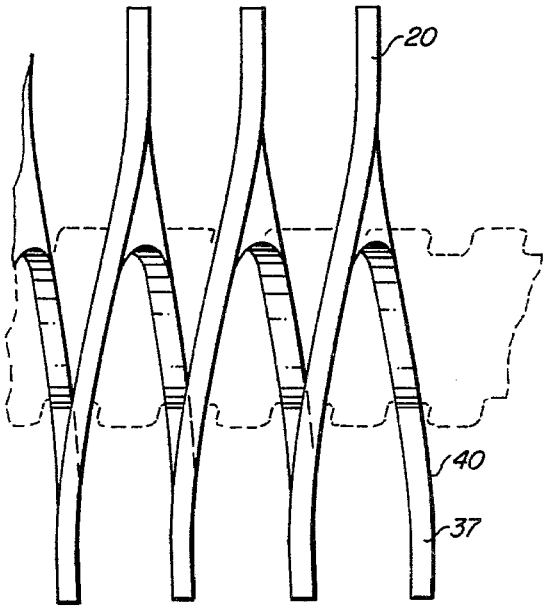
FIG-4
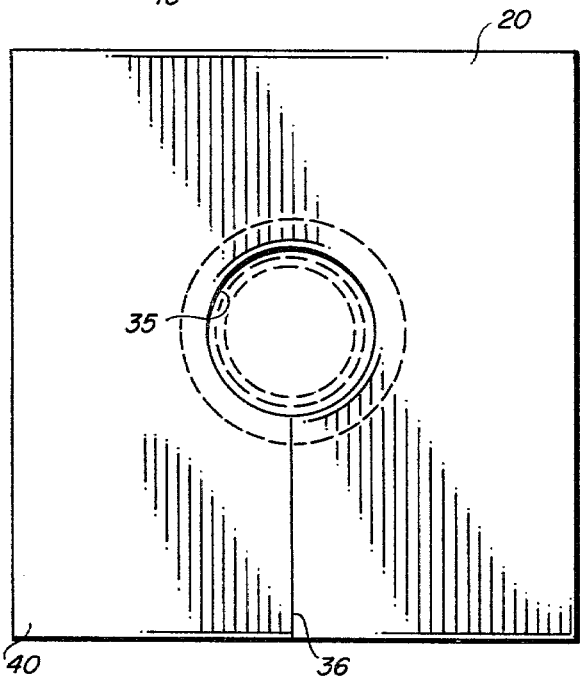
FIG-5
FIG-2
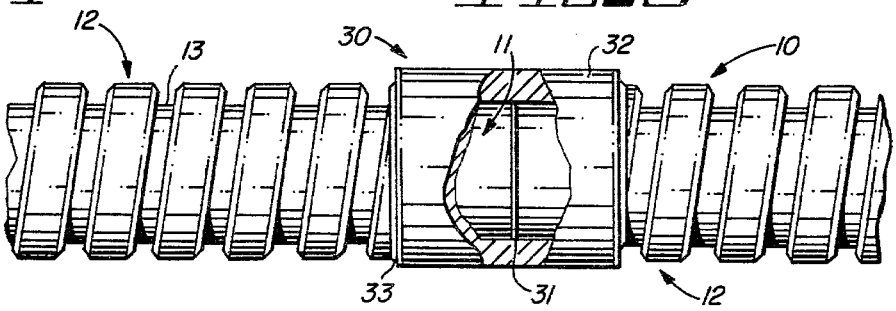

HEAT EXCHANGER APPARATUS

BACKGROUND OF THE INVENTION

The present invention relates to heat exchangers and especially to a new finned coaxial pipe heat exchanger.

This invention relates to a heat exchanger unit which can be utilized with solar heaters or with heat pumps, air conditioning systems or industrial cooling equipment. The heat exchanger unit is especially suited to transfer heat between one or more liquids circulating in the heat exchanger and the atmosphere in an efficient and reliable manner.

In the past, various types of dual pipe heat exchangers have been provided, such as a tubing spiralled around a center pipe for use in solar heaters or the like. Typical prior patents can be seen in my prior U.S. Pat. Nos. 2,023,417 and 2,037,378 and in U.S. Pat. No. 4,261,333 as well as in the references cited in the latter patent. The latter patent is directed primarily to a solar heat exchanger and avoids the problem of winding the tubing around a central pipe to make a more efficient heat exchanger. The present heat exchanger is formed out of coaxial pipe with a deep spiral groove having a generally square U-shape cross-section formed onto a central pipe. The grooves are found in the outer pipe with sufficient force to groove the central pipe so that the grooves from the outer pipe extend into the grooves formed in the center pipe to give a better contact between center and outer pipes for the transfer of heat. The spiral grooves in the center pipes also give a better flow pattern by the creation of a flow turbulence in fluid passing through the center pipe. The outer spiralling passageway is formed from a single outer pipe which requires connecting a spiralling passageway to a source of fluid, as well as connecting the center pipe to a second source of fluid without the fluids coming in contact. Special cooling fins are formed in the outer grooves in contact with the bottom of the grooves to provide additional transfer of heat from the center and outer pipes.

SUMMARY OF THE INVENTION

A heat exchanger apparatus is provided with a center pipe and coaxial mounted outer pipe. The outer pipe has a deep spiralling groove formed therein pressing against the center pipe to form a spiralling passageway between the center and outer pipes. The center pipe has matching spiralled grooves fitting therein. Co-acting grooves are formed in the making of the pipes and the grooves of the center and outer pipes are formed simultaneously. The inner grooved portions of the central pipe provides a greater surface area and a spiralling turbulence to a fluid passing through the center pipe. Heat exchanger fins are mounted in the grooves of the outer pipe in contact with the bottom and sides of the spiralling grooves of the outer pipe to transfer heat to or from both the central and outer pipes. An end coupling is provided for the heat exchanger to couple the outer passageway to an input or output line while allowing a separate connection of the central pipe. Abutting heat exchanger pipes are connected with the center pipes being first soldered or brazed together and a sleeve soldered or brazed over the ends of the outer pipe so that outer and center pipes are connected separately.

BRIEF DESCRIPTION OF THE DRAWINGS

Other objects, features and advantages of the present invention will be apparent from the written description and the drawings, in which:

FIG. 2 is a broken away elevation connecting abutting heat exchangers in accordance with the present invention;

FIG. 3 is a prospective view of the heat exchanger in accordance with the present invention having one fin explored therefrom;

FIG. 4 is an elevation view of the connected fins in accordance with the present invention; and FIG. 5 is a side elevation of the fins in accordance with FIGS. 3 and 4.

DESCRIPTION OF THE PREFERRED EMBODIMENTS

Figure 1:
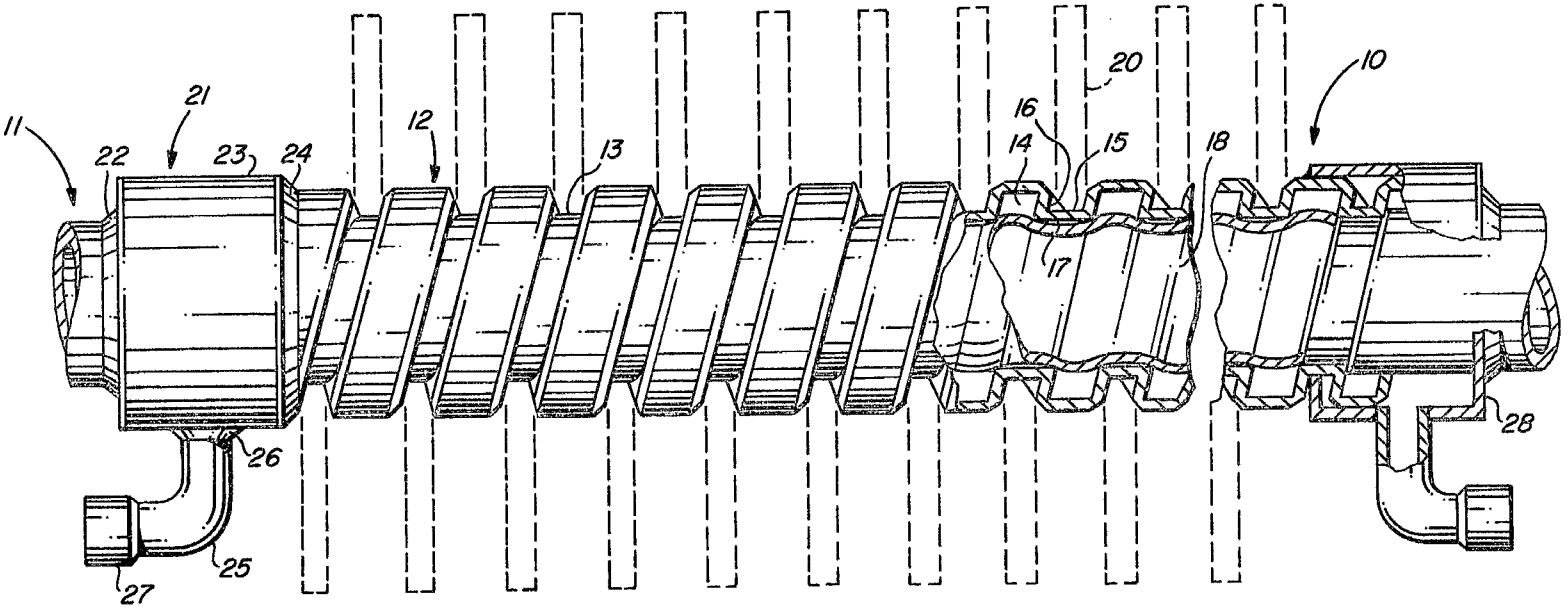
FIG. 1 is a broken away elevation showing the heat exchanger in accordance with the present invention having cooling fins shown thereon.

Referring to the drawings and especially to FIGS. 1 and 2, a heat exchanger 10 is shown having a center pipe 11 and an outer coaxial mounted pipe 12. Outer pipe 12 has spiralling deep set grooves 13 formed therein to form a spiralling passageway 14 around the center pipe 11. Grooves 13 have grooved bottoms 15 and sides 16 forming an almost square U-shape and protruding into smaller spiralling grooves 17 and formed in the pipe 11. That is, the bottom of the spiralling grooves 15 fit into the top of the spiralling grooves 17 in the center pipe 11. Thus, the center pipe 11 has interior spiralling grooves 18 which causes a spiralling turbulence of fluids passing through the center pipe 11. A better contact is made between the outer pipe and center pipe by the more complete contact of the grooves 13 and 17 and provides a more direct heat path to fins 20 shown in phantom in FIG. 1. Co-acting grooves between the center pipe 11 and the outer pipe 12 is brought about by the forming of the grooves in the outer pipe onto the center pipe under great force to thereby create the grooves in both pipes simultaneously. The pipes may typically be made out of copper or other mal metal. An end coupling 21 is provided for sliding over the center pipe 11 and over the end of the outer pipe 12. A soldered or brazed joint 22 connects the sleeve 23 to the tube 11 while a soldered or brazed joint 24 connects the sleeve 23 to the outer pipe 12. An L-connector 25 is connected through the sleeve 23 by a soldered or brazed joint 26 and has a connecting portion 27 for connecting an input or output to the passageway 14 formed by the outer pipe 12. Connecting joints 21 are made with the L-connectors 25 ready for attachment to the end of the heat exchanger and may include an annular wall 28. In this matter, a pipe 11 may be connected to fluid input or output lines while the pipe 12 may be connected to a separate input or output line through the connection 25.

It, of course, will be clear that the pipes can be connected to each other to have the fluid flow through one of the pipes and then into the other.

FIG. 2 shows a pair of heat exchangers 10 having abutting joint 30 formed with the solder or brazed joint 31 connecting the center pipes 11 and a sleeve 32 fitting over the outer pipes 12 adjacent their abutting ends and being soldered or brazed with a pair of soldered or brazed joints 33 to the outer pipe 12 so that the outer pipes and inner pipes are separately connected by the joint 30.

FIG. 3 shows the cooling fins 34 connected to the heat exchanger pipes 10. Each cooling fin 34 has a center aperture 35 and is split to one outer edge at 36 and has a surface edge 37 and a surface edge 38 and having a bent portion 40 of the fin 34. The edge of the aperture 35 forms a portion of a single thread for threading the fin 34 onto the heat exchanger pipe 10 in the grooves 13 by bending one portion of the fin 34. As each fin 34 is threaded onto the pipes 12, the abutting edge 38 engages the next adjacent fin abutting edge 37 to form a continuously connected series of fins. Each fin may also have a wavey pattern or grooves formed thereon to increase the surface area of the fins and each is formed for a tight press-fit into the grooves 13 to increase the flow of heat between the pipes 10 and the fins 34. The edge 37 of one fin may also be connected to the abutting edge adjacent fin 38 by the pressure of the two edges pushing against each other or may be connected with an adhesive or soldered, as desired.

The pattern of the connecting fins is more clearly seen in FIG. 4, so that all the fins accumulatively form a thread with apertures 35 which is threaded onto the spiralling grooves formed in the outer pipe 12, which resembles and acts as external threads. The fins can be made of aluminum or any material desired which can transfer and dissipate heat.

It should be clear at this point that a heat exchanger has been provided which because of its construction is especially adapted for industrial usage. It should also be clear that lighter duty versions, such as might be used as an oil cooler on an internal combustion engine, can be made without departing from the spirit and scope of the invention. Accordingly, the present invention is not to be construed as limited to the forms shown which are to be considered illustrative rather than restrictive.

I claim:

1. A heat exchanger comprising in combination:

a center pipe;

a coaxially mounted outer pipe mounted over said center pipe and have spiralling grooves formed therein against said center pipe;

heat exchanger fins formed in said outer pipe grooves to thereby transfer heat from said center and outer pipes; and said heat exchanger fins being shaped to have an opening therethrough and a split from each opening to one edge thereof, one side of said split being bent whereby said fins can be threaded onto said outer pipe grooves.

2. A heat exchanger in accordance with claim 1, in which each split end of each fin abuts the next adjacent heat exchanger fin split end to form continuous spiralling heat exchange fins.

3. A heat exchanger comprising in combination:

a center pipe having spiralling grooves formed therein;

a coaxially mounted outer pipe mounted over said center pipe and having spiralling grooves formed therein against said center pipe to form a spiralling passageway around said center pipe and having said outer pipe grooves partially formed in the grooves in said center pipes;

heat exchanger fins formed in said outer pipe grooves to thereby transfer heat from said center and outer pipes; and an end coupling fitted around said center pipe over one end of said outer pipe and being attached thereto and having an opening therefrom whereby said first and second pipes have separate openings thereinto, said end coupling opening having a pipe coupling attached thereto for connecting fluid handling pipes to said outer passageway formed by said outer pipe.

4. A heat exchanger in accordance with claim 1, in which said outer pipe spiralling grooves are U-shaped grooves.

5. A heat exchanger in accordance with claim 4, in which said center and outer pipes are made substantially of copper.

6. A heat exchanger in accordance with claim 5, in which the heat exchanger fins are made of aluminum.

7. The heat exchanger in accordance with claim 6, in which said aluminum heat exchanger fins have a wavey surface to increase a dissipation of heat therefrom.

8. A heat exchanger in accordance with claim 1, in which said end coupling is attached with a soldered joint.

9. A heat exchanger in accordance with claim 1, in which a pair of heat exchanger center pipes are connected together and a pair of outer pipes are connected together with a sleeve attached over abutting ends thereof.

10. A heat exchanger in accordance with claim 9, in which said sleeve is attached to said outer pipes with soldered joints.

* * * * *